US009757007B2

(12) United States Patent
Mongeon et al.

(10) Patent No.: US 9,757,007 B2
(45) Date of Patent: Sep. 12, 2017

(54) KIT HAVING A PACKAGE CONTAINING CLEANING IMPLEMENTS, PACKAGE THEREFOR AND BLANK THEREFOR

(71) Applicant: The Procter & Gamble Company, Cincinnati, OH (US)

(72) Inventors: Murphy Greene Mongeon, Cincinnati, OH (US); Jose Juan Fuentes, Jr., West Chester, OH (US); Marcus Paul McDuffie, Cincinnatti, OH (US); Yassir Halty, Blue Ash, OH (US); Richard Lee Lane, Cincinnati, OH (US); Matthew Joshua Brewer, Deerfield Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 2 days.

(21) Appl. No.: 15/161,401

(22) Filed: May 23, 2016

(65) Prior Publication Data

US 2016/0262592 A1 Sep. 15, 2016

Related U.S. Application Data

(63) Continuation of application No. 14/515,717, filed on Oct. 16, 2014.

(51) Int. Cl.

| | |
|---|---|
| ***B65D 5/18*** | (2006.01) |
| ***A47L 13/51*** | (2006.01) |
| ***B65D 5/00*** | (2006.01) |
| ***B65D 5/42*** | (2006.01) |
| ***B65D 75/06*** | (2006.01) |
| ***B65D 75/52*** | (2006.01) |

(52) U.S. Cl.

CPC ..... *A47L 13/51* (2013.01); *B65D 5/0095* (2013.01); *B65D 5/18* (2013.01); *B65D 5/4204* (2013.01); *B65D 75/06* (2013.01); *B65D 75/522* (2013.01)

(58) Field of Classification Search

CPC ..... A47L 13/51; B65D 5/0095; B65D 5/18; B65D 5/4204; B65D 5/5007; B65D 5/5009; B65D 5/5018; B65D 5/5019; B65D 75/06; B65D 75/522; G01N 21/64

USPC ..... 206/362, 362.4, 775–784; 229/162.1, 229/162.6, 162.7

See application file for complete search history.

(56) References Cited

U.S. PATENT DOCUMENTS

| | | | |
|---|---|---|---|
| D94,581 | S | 12/1935 | Ward |
| 2,654,470 | A | 10/1953 | Borucki |
| 2,773,589 | A | 12/1956 | Hennessey |

(Continued)

OTHER PUBLICATIONS

U.S. Appl. No. 29/506,478, filed Oct. 16, 2014, Mongeon, et al.

(Continued)

*Primary Examiner* — Bryon Gehman

(74) *Attorney, Agent, or Firm* — Larry L. Huston; Steven W. Miller

(57) ABSTRACT

A blank for a package, a package, and a kit having a package with a cleaning implement therein. The package has a front panel and side panels with a transition that provides for regions of relatively greater and relatively lesser depth in said package. A window is disposed in the front panel, and registered with the portions of the side panel having relatively lesser depth. This geometry provides the benefit that the package may hold all contents deemed helpful at point of sale, while allowing the cleaning implement to be visible through or protrude through the window without shadows being cast from the side panels.

17 Claims, 9 Drawing Sheets

(56) References Cited

U.S. PATENT DOCUMENTS

| | | | |
|---|---|---|---|
| 2,829,778 | A | 4/1958 | Carabet |
| 2,854,181 | A | 9/1958 | Smith |
| 3,077,978 | A | 2/1963 | Krzyzanowski |
| 3,680,687 | A | 8/1972 | Alessio |
| 3,869,062 | A | 3/1975 | Jaeschke et al. |
| 4,177,917 | A | 12/1979 | Webinger |
| 4,355,758 | A | 10/1982 | Lavery |
| 5,085,316 | A | 2/1992 | Pearce |
| 5,495,983 | A | 3/1996 | Lelek |
| 5,971,265 | A | 10/1999 | Collins |
| 6,059,180 | A | 5/2000 | Collins |
| 6,474,539 | B1 | 11/2002 | Van Der Horst |
| 8,607,987 | B2 | 12/2013 | Oja |
| 2003/0226784 | A1 | 12/2003 | Petner |
| 2006/0283741 | A1 | 12/2006 | Bin |
| 2013/0087476 | A1 | 4/2013 | Keefe |
| 2014/0138512 | A1 | 5/2014 | Van Rens |

OTHER PUBLICATIONS

Packaging sold in the US, May 2014.
Commercially available Packaging sold in the US, Feb. 2015.
Bona Microfiber Floor Mop, Item WM710013432; Ordered Online Sep. 23, 2014; http://www.amazon.com/Bona-WM710013432-Microfiber-Floor-Mop/dp/B00DVHIF06/ref=sr__1__1?ie=UTF8&qid=1414064394&sr=8-1&keywords=BONA+MICROFIBER+FLOOR+MOP.
Rubbermaid Reveal TM Microfiber Spray Mop in original box; © 2013 Rubbermaid Incorporated.

KIT HAVING A PACKAGE CONTAINING CLEANING IMPLEMENTS, PACKAGE THEREFOR AND BLANK THEREFOR

FIELD OF THE INVENTION

The present invention relates to packaging and more particularly to packaging for cleaning implements and which can be used at point of sale.

BACKGROUND OF THE INVENTION

Cleaning products are in constant use in daily life. Some cleaning products include both a cleaning implement and a refill therefor. The cleaning products may include a reusable device and sheet, or other refill, removably attachable thereto. The sheet may be discarded after a single use, used a few times or laundered and restored. Often the implement and refill are sold together as a kit.

The kit may be advertised, displayed and sold at point of sale in a package. Such packaging performs multiple functions. For example, the packaging protects the implement, and any refill optionally sold therewith, during transport to the store, and again to the user's home or other point of use. The packaging holds the optional refill(s) together with the implement, if they are sold as a kit, to prevent the user from mixing incompatible products. The packaging further provides for display of the implement, and any other contents, so the use is aware what s/he is purchasing.

Typical packaging includes a cardboard box. The box may be generally or exactly parallelepipedally shaped, particularly elongate and in a degenerate case may subtend a cubical shape. But the well known tradeoff is still present. The box is preferably strong enough to present the contents during shipping to and handling at point of sale, but not require excessive material creating undue expense.

Environmental concerns also are a consideration in not using excessive material—beyond that needed to hold a kit together and protect the contents. Yet another consideration is point of display. The implement may be irregularly shaped, making the package difficult to display at point of sale. Yet, the package should be easy for the retail personnel to properly stock, so that display is correct at the point of sale.

Finally, the package allows the prospective purchaser to view the contents of the package, to make the purchase decision. Illumination in a retail setting may be uneven or generally poor. The prospective purchaser may approach the packaging from either the left or right side, as s/he walks through an aisle.

Various attempts have been made in the art to deal with the tradeoffs and competing requirements set forth above, as disclosed in US patents and application: U.S. Pat. Nos. 2,854,181; 3,869,062; 4,177,918; 5,495,983; 5,971,265; 6,059,180; 6,474,539 and 2013/0087476. The attempts generally include front windows, windows which intercept two contiguous sides of the package, and interior compartments. But none of these attempts solve the problems or resolve the tradeoffs noted above.

SUMMARY OF THE INVENTION

In various embodiments, the invention comprises a blank for a variable depth windowed package, a variable depth windowed package, and a kit having a variable depth windowed package having a cleaning implement therein.

The package has a front panel and side panels with a transition that provide for regions of relatively greater and lesser depth. A window is disposed in the front panel, registered with the portions of the side panel having relatively lesser depth. This geometry provides the benefit that the package may hold all contents deemed helpful at point of sale, while allowing the cleaning implement to protrude through the window without shadows being case from the side panels.

DETAILED DESCRIPTION OF THE INVENTION

Figure 1:
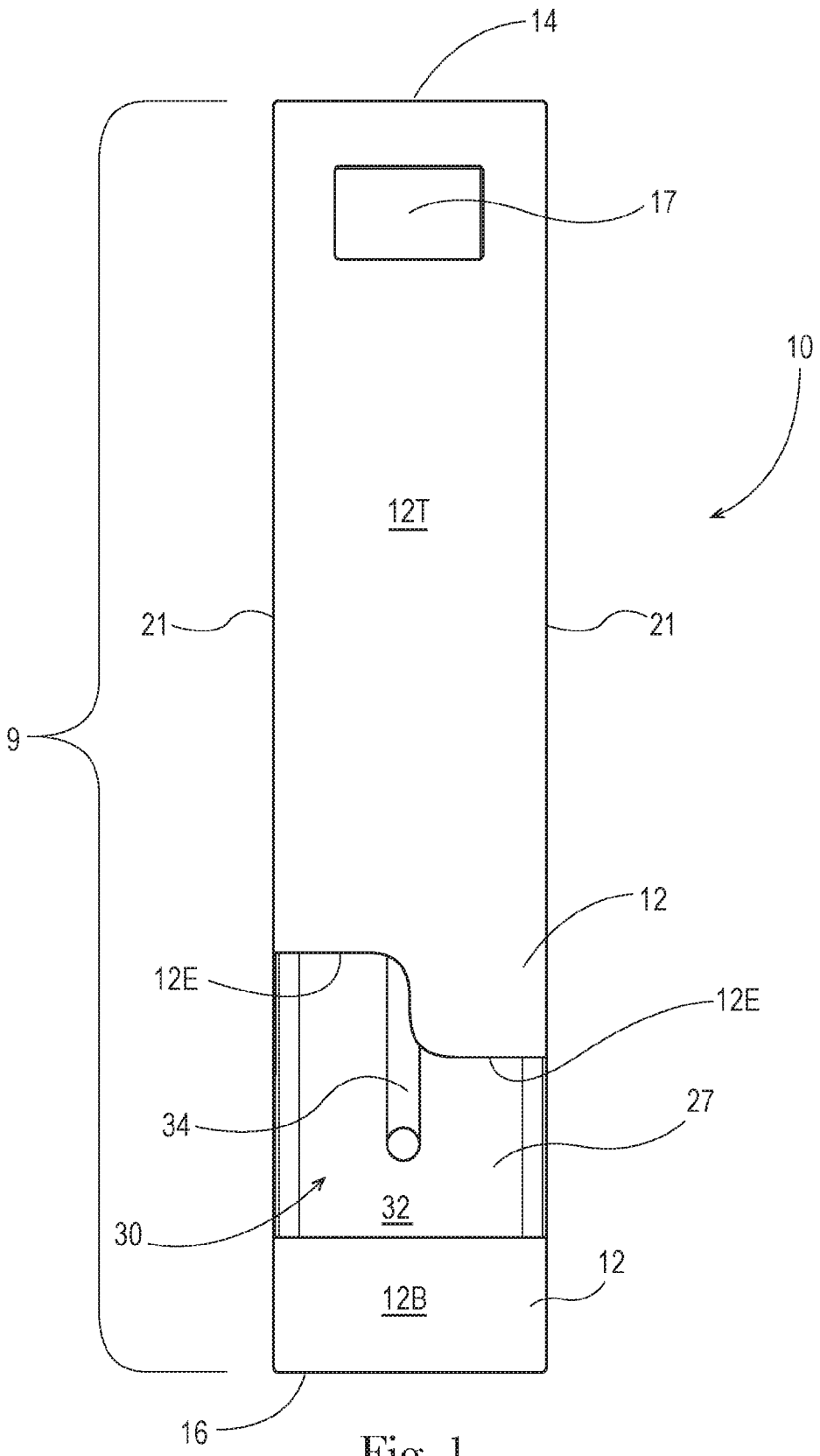
FIG. 1 is a frontal view of a kit according to the present invention.

Referring to FIG. 1, the invention, in various embodiments, is a kit (9) including a package (10) and contents, a package (10), and a blank (40) for such a package (10). The package (10) may be generally or exactly parallelepipedally shaped and include at least one front panel (12), an optional back panel (14) opposed thereto, a bottom panel (18), an optional top panel (16) opposed thereto and a side panel (21) and optional opposed side panel (21) opposed thereto.

Figure 2A:
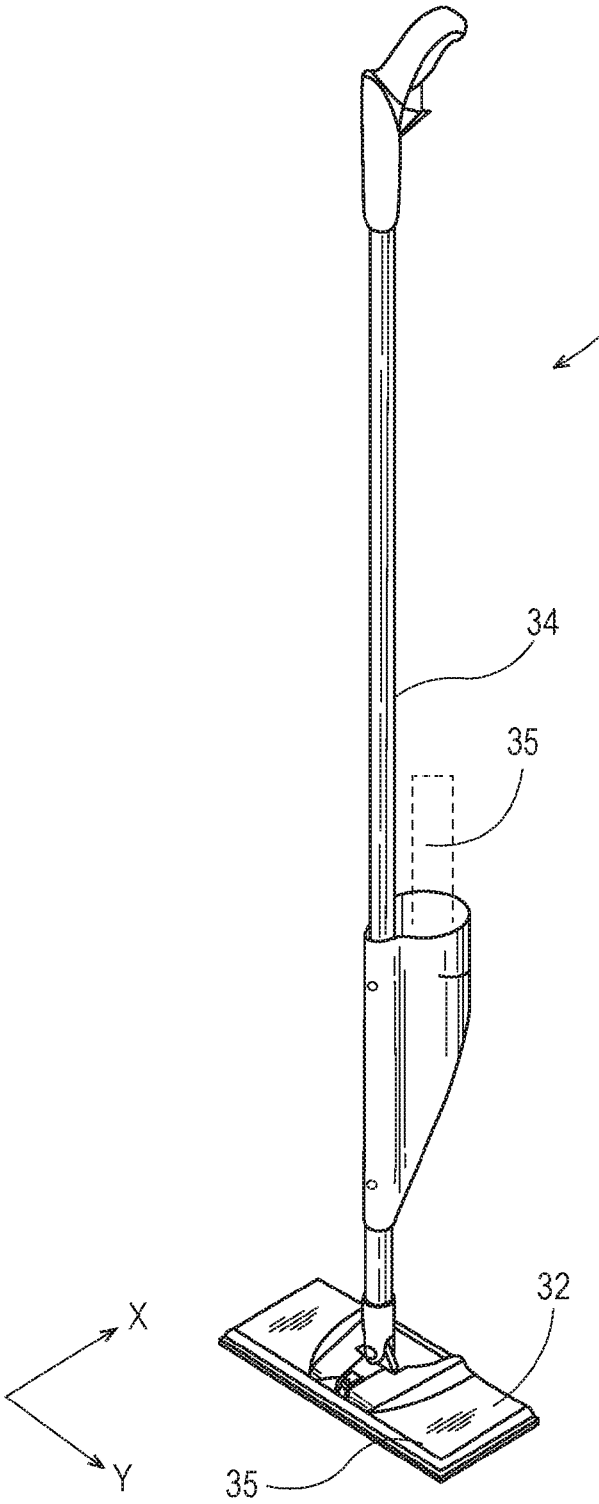
Fig. 2A PRIOR ART
FIG. 2A is a perspective view of an exemplary prior art cleaning implement, useful for spraying cleanser onto a floor, having a liquid refill shown in phantom.
Figure 2B:
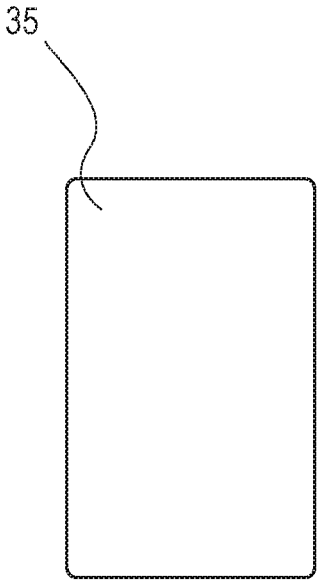
Fig. 2B PRIOR ART
FIG. 2B is a plan view of a prior art refill cleaning sheet suitable for use with the present invention.

Referring to FIGS. 2A-2B, the optional contents of the package (10) may include a cleaning implement (30) and further optionally a cleaning sheet (35), liquid refill (35) or duster (35). Together a package (10), and at least an implement (30) and/or refills (35), such as a cleaning sheet (35) and/or cleaning liquid (35), comprise a kit (9).

Figure 3:
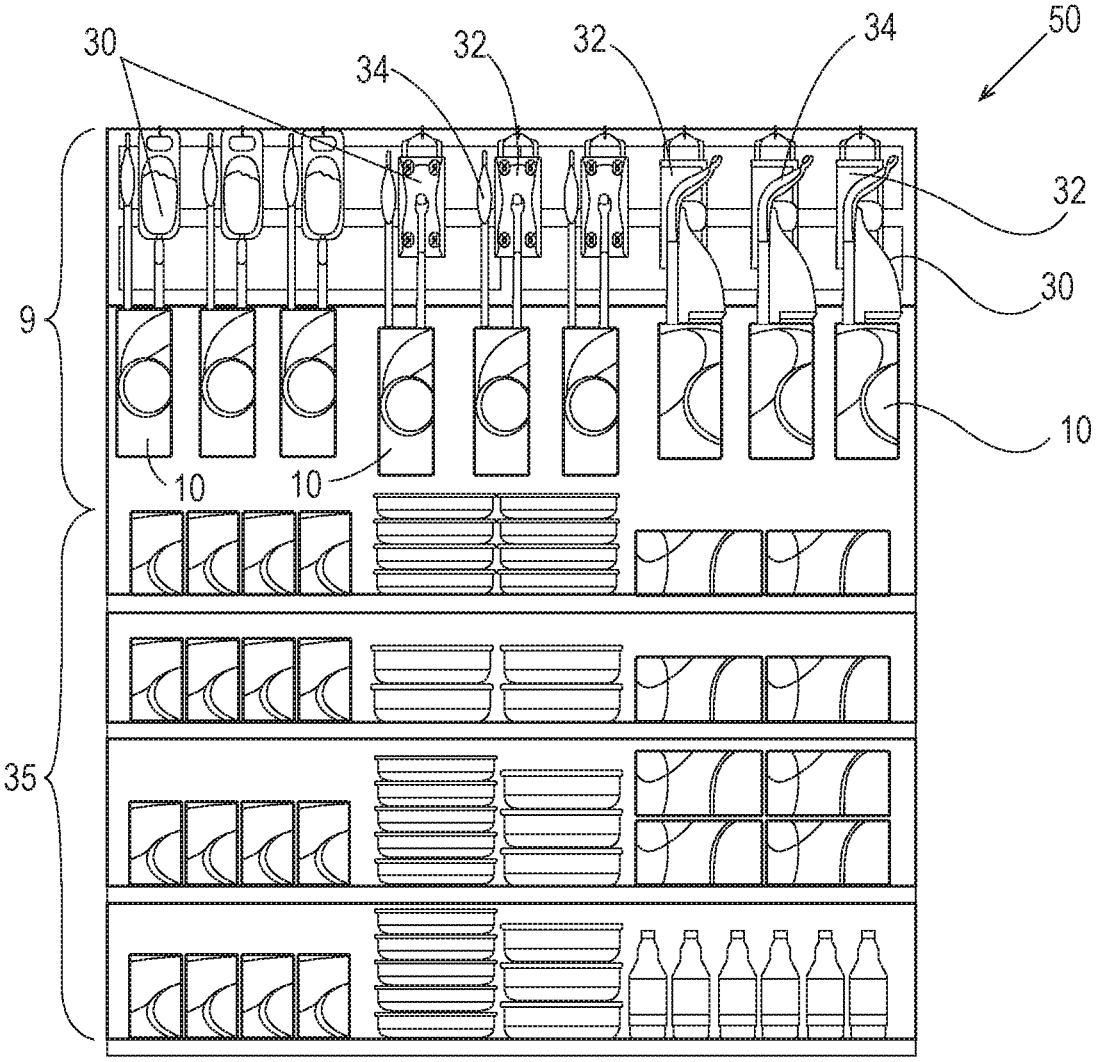
Fig. 3 PRIOR ART
FIG. 3 is a frontal view of a retail display according to the prior art.
Figure 4:
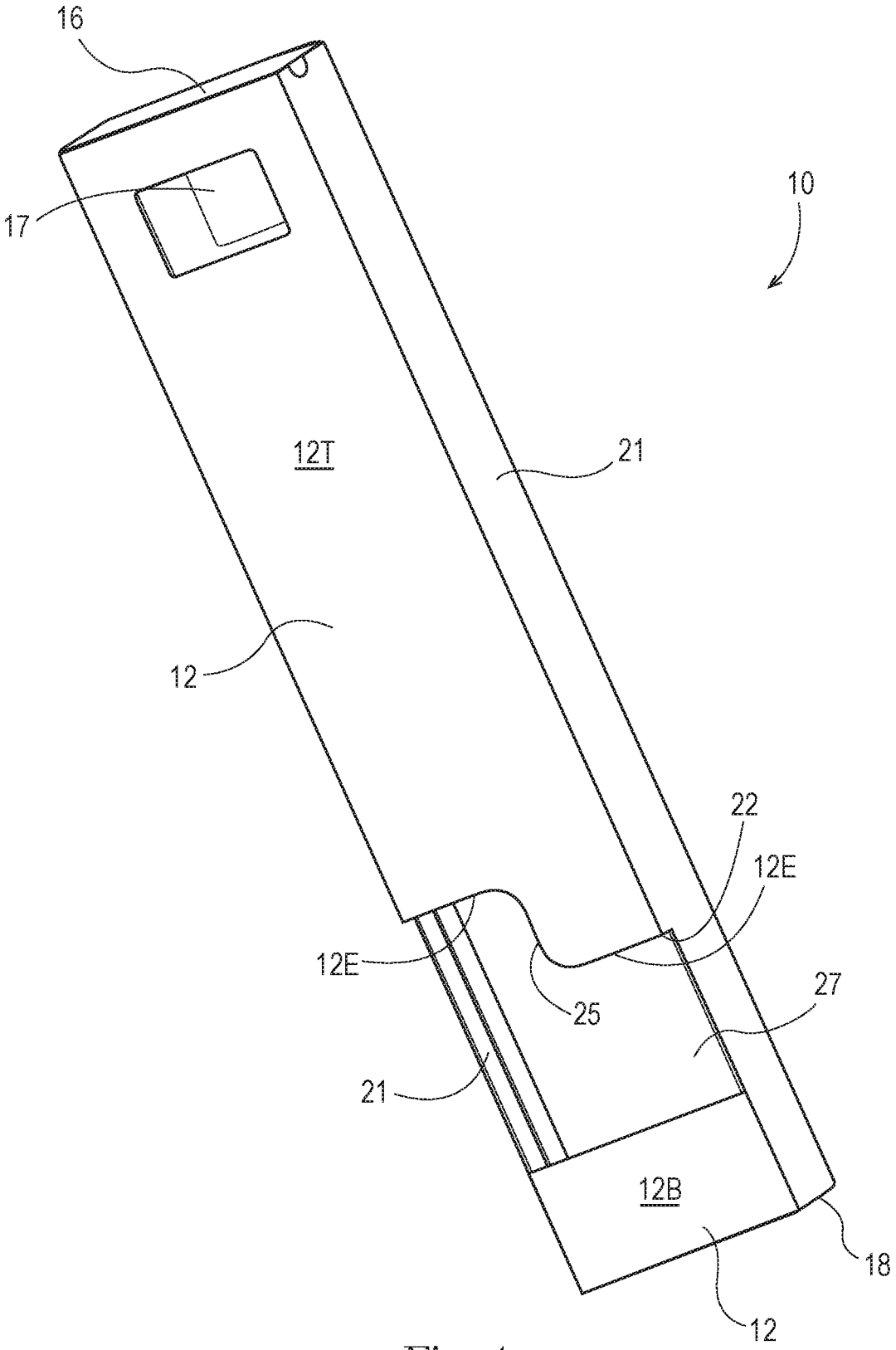
FIG. 4 is a perspective view of a package according to the present invention.
Figure 5A:
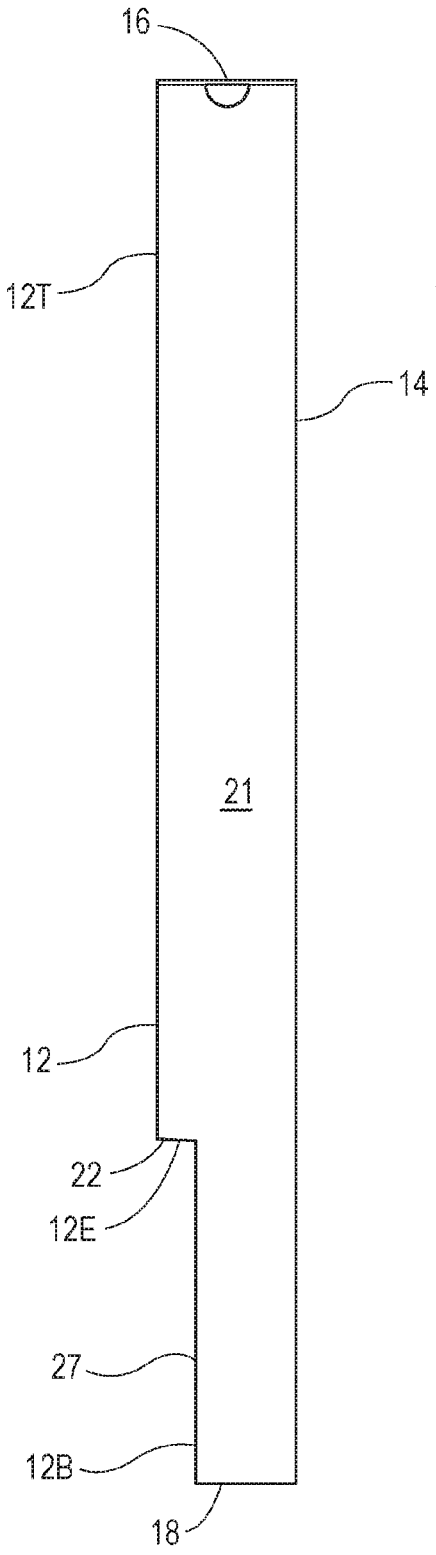
FIGS. 5A-5D are profile views of the package of FIG. 4, with FIGS. 5A and 5C being the left side profile, FIGS. 5B and 5D being the right side view, and FIGS. 5C-5D having broken lines to show indeterminate length in the longitudinal direction.
Figure 5B:
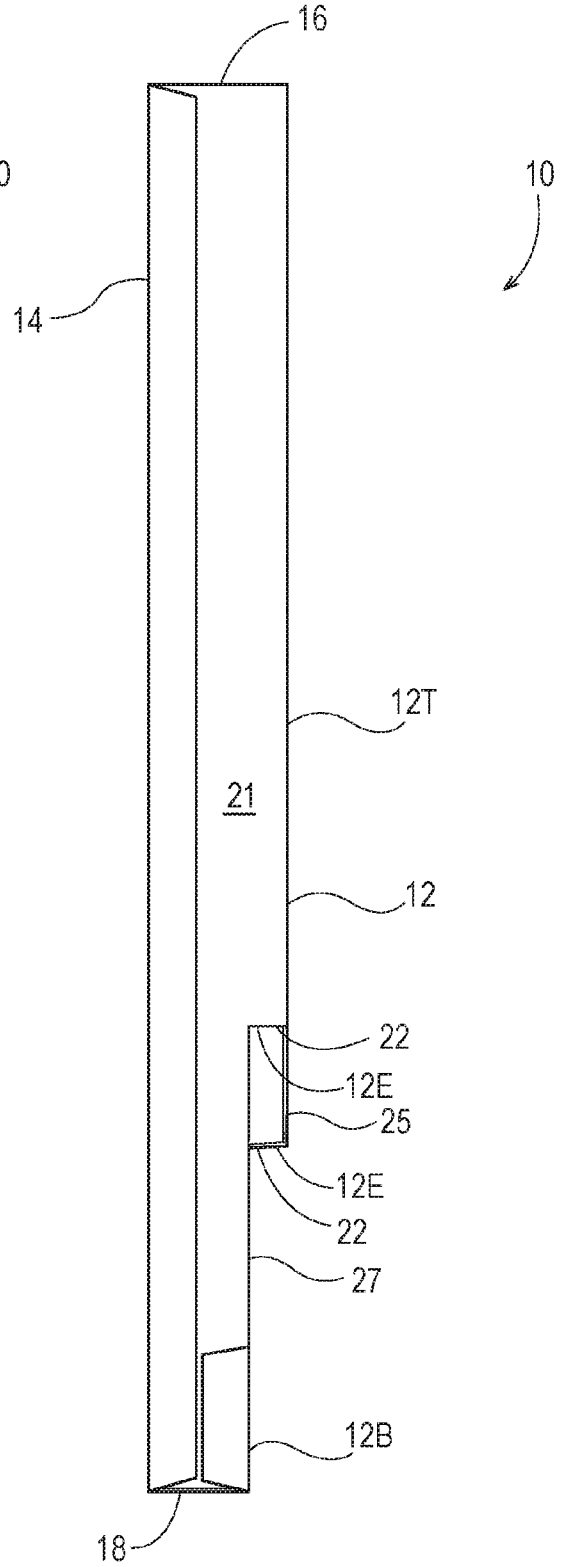
Figure 5C:
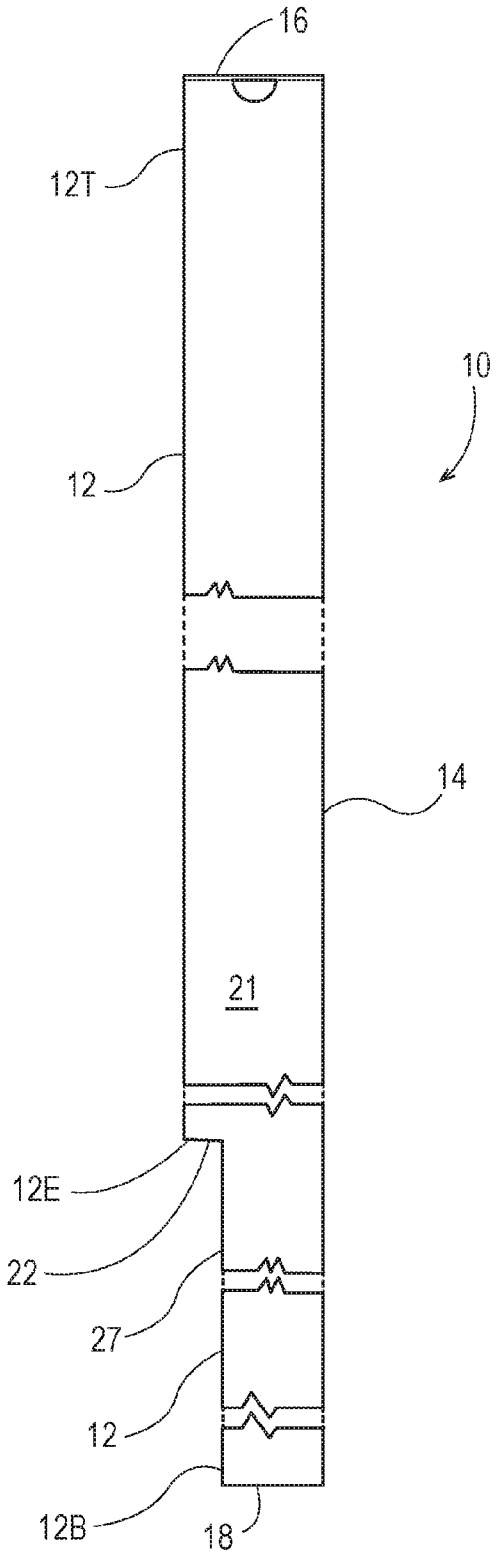
Figure 5D:
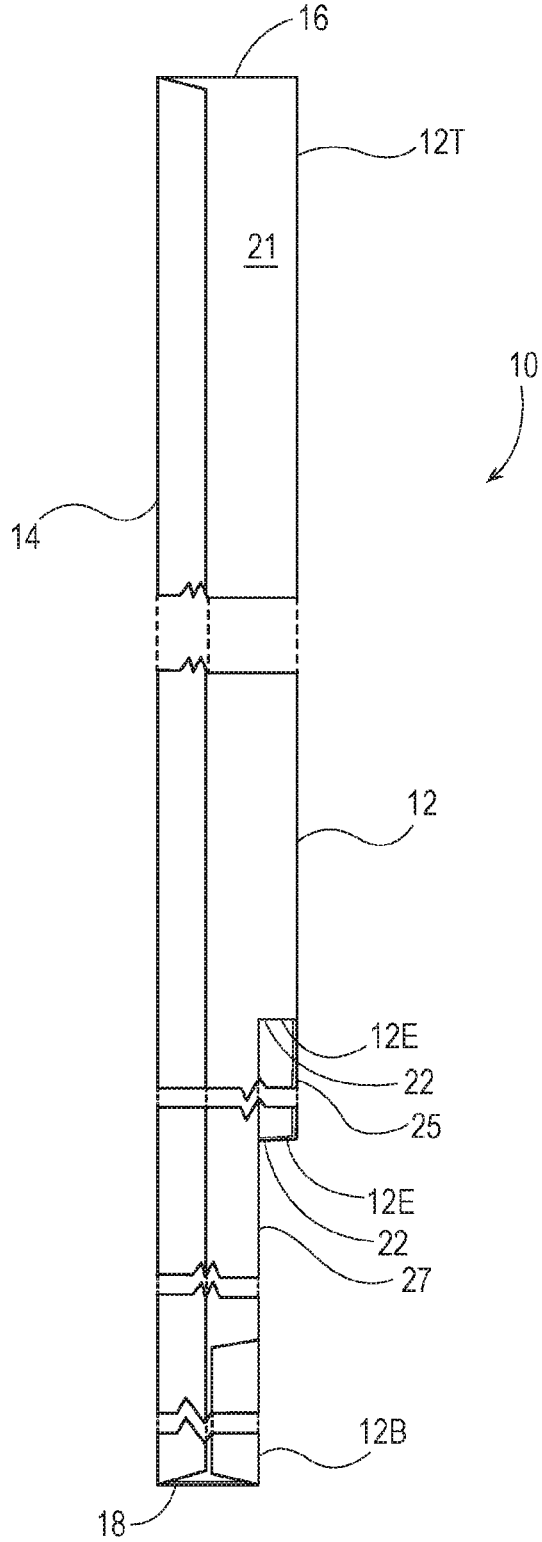
Figure 6A:
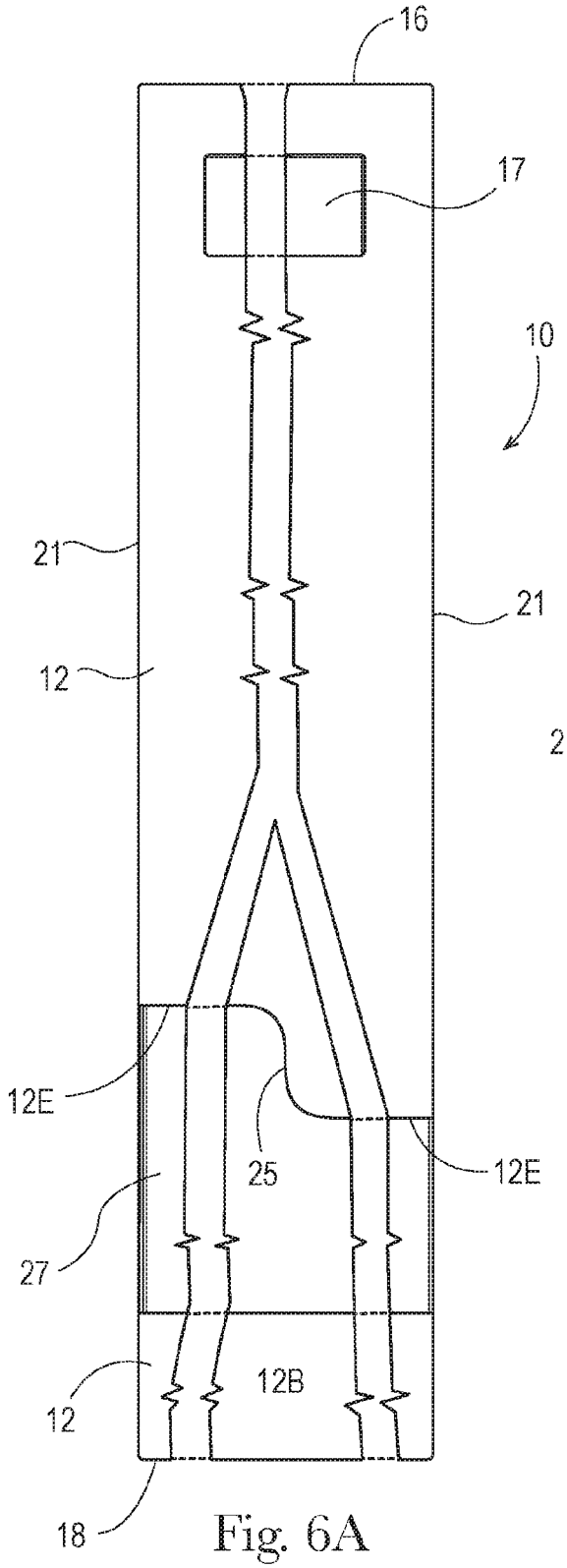
FIGS. 6A and 6B are frontal and rear views, respectively, of the package of FIGS. 1, 4 and 5A-5D, having broken lines to show indeterminate width, indeterminate depth also being within the scope of the invention.
Figure 6B:
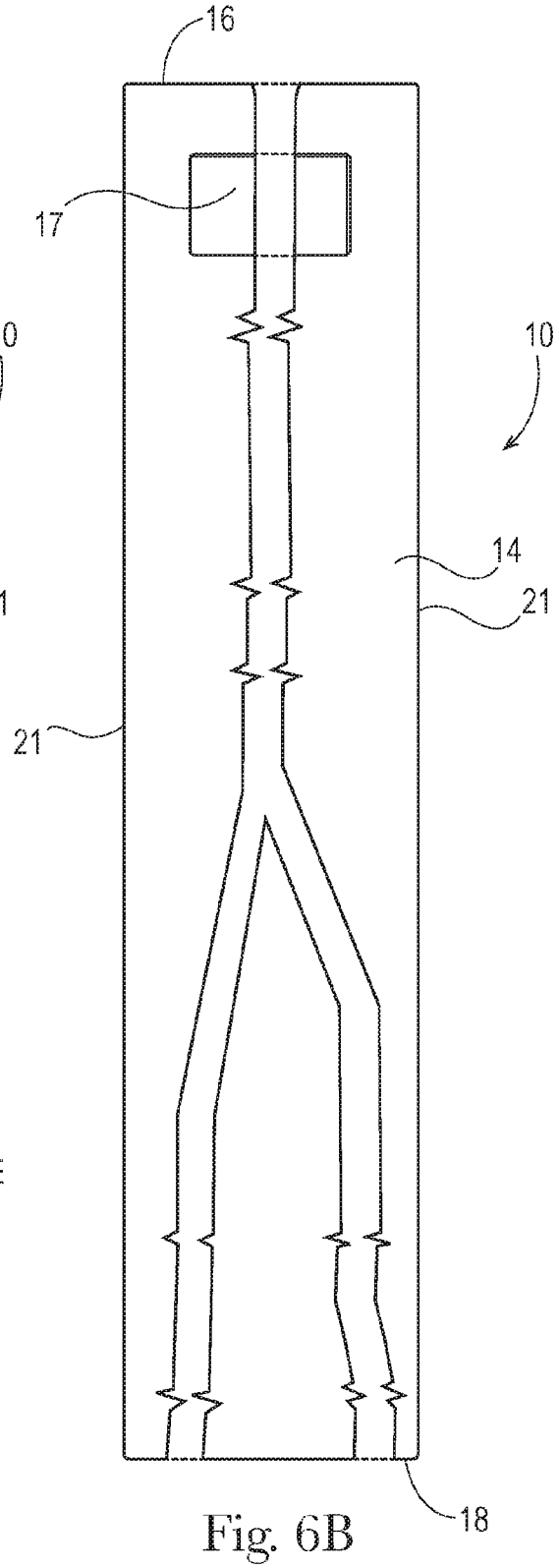

Referring to FIG. 3, the kits (9), refills (35) and/or implements (30) may be sold at a display (50). The display (50) may comprise any desired combination of various kits (9), refills (35) and/or implements (30) hung on wire racks, disposed on shelves, etc. But this particular type of display does not necessarily provide for efficient use of the package (10) or providing the consumer all of the items needed for recurring cleaning tasks.

Referring back to FIGS. 2A-2B, a suitable cleaning sheet (35) may comprise a nonwoven. The nonwoven may be synthetic and/or have cellulosic fibers therein. The synthetic fibers may comprise carded, staple, wet laid, air laid and/or spunbond fibers. The nonwoven cleaning sheet (35) may be made according to a hydro-entangling process to provide a texture and a basis weight of about 20 to about 120 gsm. Optionally, the cleaning sheet (35) may further comprise an additive, to improve cleaning performance and/or enhance the cleaning experience. The additive may comprise wax, such as microcrystalline wax, oil, adhesive, perfume and combinations thereof. The cleaning sheet (35) according to the present invention may be made according to commonly assigned U.S. Pat. Nos. 6,305,046; 6,484,346; 6,561,354; 6,645,604; 6,651,290; 6,777,064; 6,790,794; 6,797,357; 6,936,330; D409,343; D423,742; D489,537; D498,930; D499,887; D501,609; D511,251 and/or D615,378.

If desired a one or more sheets may be disposed in an interior compartment, to fixedly dispose the sheets within the package (10). A thermoform may be used for the interior compartment. This arrangement provides the benefit that a thermoform may be made to conform to the interior dimensions of the package (10) and thereby not shift from the desired position during shipping.

If desired, the cleaning sheet (35) may be pre-moistened. If the cleaning sheet (35) is pre-moistened, it is preferably pre-moistened with a liquid which provides for cleaning of the target surface, such as a floor, but yet does not require a post-cleaning rinsing operation. The pre-moistened cleaning sheet (35) may comprise natural or synthetic fibers. The fibers may be hydrophillic, hydrophobic or a combination thereof, provided that the cleaning sheet (35) is generally absorbent to hold, and express upon demand, a cleaning solution. In one embodiment, the cleaning sheet (35) may comprise at least 50 weight percent or at least 70 weight percent cellulose fibers, such as air laid SSK fibers. If desired, the cleaning sheet (35) may comprise plural layers to provide for scrubbing, liquid storage, and other particularized tasks for the cleaning operation. The cleaning sheet (35) may be loaded with at least 1, 1.5 or 2 grams of cleaning solution per gram of dry substrate, but typically not more than 5 grams per gram. The cleaning solution may comprise a surfactant, such as APG surfactant which minimizes streaking since there is typically not a rinsing operation, agglomerating chemicals, disinfectants, bleaching solutions, perfumes, secondary surfactants etc. Optionally, the pre-moistened cleaning sheet (35) may further comprise a scrubbing strip. A scrubbing strip is a portion of the cleaning sheet (35) which provides for more aggressive cleaning of the target surface. A suitable scrubbing strip may comprise a polyolefinic film, such as LDPE, and have outwardly extending perforations, etc. The scrubbing strip may be made and used according to commonly assigned U.S. Pat. Nos. 8,250,700; 8,407,848; D551,409 S and/or D614,408 S. A suitable pre-moistened cleaning sheet (35) maybe made according to the teachings of commonly assigned U.S. Pat. Nos. 6,716,805; D614,408; D629,211 and/or D652,633.

If desired, the cleaning sheet (35) may comprise plural layers, to provide for absorption and storage of cleaning fluid deposited on the target surface. If desired, the cleaning sheet (35) may comprise absorbent gelling materials to increase the absorbent capacity of the cleaning sheet (35). The absorbent gelling materials may be distributed within the cleaning sheet (35) in such a manner to avoid rapid absorbency and absorb fluids slowly, to provide for the most effective use of the cleaning sheet (35). The cleaning sheet (35) may comprise plural layers disposed in a laminate. The lowest, or downwardly facing outer layer, may comprise apertures to allow for absorption of cleaning solution therethrough and to promote the scrubbing of the target surface. Intermediate layers may provide for storage of the liquids, and may comprise the absorbent gelling materials. The top, or upwardly facing outer layer, maybe liquid impervious in order to minimize loss of absorbed fluids. The top layer may further provide for releasable attachment of the cleaning sheet (35) to a cleaning implement (30). The top layer may be made of a polyolefinic film, such as LDPE. The cleaning sheet (35) may have an absorbent capacity of at least 10, 15, or 20 grams of cleaning solution per gram of dry cleaning sheet (35), as set forth in commonly assigned U.S. Pat. Nos. 6,003,191 and 6,601,261.

The cleaning sheet (35) according to the present invention may be used with a stick-type cleaning implement (30). The cleaning implement (30) may comprise a plastic head (32) for holding the cleaning sheet (35) and an elongate handle (34) articulably connected thereto. The handle (34) may comprise a metal or plastic tube or solid rod. The handle (34) may be unitary or segmented and assembled at point of use in known fashion and define a longitudinal axis, which axis is coincident the longitudinal axis of the elongate package (10).

The head (32) may have a downwardly facing surface, to which the sheet (35) may be attached. The downwardly facing surface may be generally or exactly flat, or slightly convex. The downwardly facing surface of the head (32) may have a width, generally or exactly perpendicular to the axis of the handle (34) and which is generally left-right oriented on the floor while the cleaning implement (30) is in use. The head (32) may have a front-back dimension, perpendicular to and generally, less than the width.

The head (32) may articulate to a position having the width generally or exactly parallel the longitudinal axis. This arrangement is believed to be particularly advantageous, as the geometry conserves space in the package (10). The head (32) may be held fixed to the handle (34), or proximate portion thereof, to reduce movement during shipping and preserve appearance at point of sale. If the front-back dimension is only slightly less that the package width, the head (32) will advantageously fit snugly in the package (10), minimizing disruption during shipping.

The head (32) may further have an upwardly facing surface. The upwardly facing surface may have a universal joint to facilitate connection of the elongate handle (34) to the head (32). The upwardly facing surface may further comprise a mechanism, such as resilient grippers, for removably attaching the cleaning sheet (35) to the implement (30). Alternatively, a hook and loop system may be used to attach the cleaning sheet (35) to the head (32). If grippers are used with the cleaning implement (30), the grippers may be made according to commonly assigned U.S. Pat. Nos. 6,305,046; 6,484,346; 6,651,290 and/or D487,173.

If desired, the cleaning implement (30) may have an axially rotatable beater bar and/or vacuum type suction to assist in removal of debris from the target surface. Debris removed from the target surface may be collected in a dust bin. The dust bin may be mounted within the head (32), or, alternatively, on the elongate handle (34). If desired, the implement (30) may also provide for steam to be delivered to the cleaning sheet (35) and/or to the floor or other target surface.

A suitable stick-type cleaning implement (30) may be made according to commonly assigned U.S. Pat. Des. No. 391,715; D409,343; D423,742; D481,184; D484,287; D484,287 and/or D588,770. A suitable vacuum type cleaning implement (30) may be made according to the teachings of U.S. Pat. Nos. 7,137,169, D484,287 S, D615,260 S and D615,378 S. A motorized implement (30) may be made according to commonly assigned U.S. Pat. No. 7,516,508. An implement (30) having a beater bar may be made according to commonly assigned US 2013/0333129. A steam implement (30) may be made according to the teachings of jointly assigned US 2013/0319463.

The cleaning implement (30) may further comprise a reservoir for storage of cleaning solution. The reservoir may be replaced when the cleaning solution is depleted and/or refilled as desired. The reservoir may be disposed on the head (32) or the handle (34) of the cleaning implement (30). The neck of the reservoir may be offset per commonly assigned U.S. Pat. No. 6,390,335. The cleaning solution contained therein may be made according to the teachings of commonly assigned U.S. Pat. No. 6,814,088. The cleaning implement (30) may further comprise a pump for dispensing cleaning solution from the reservoir onto the target surface, such as a floor. The pump may be battery powered or operated by line voltage. Alternatively, the cleaning solution may be dispensed by gravity flow. The cleaning solution may be sprayed through one or more nozzles to provide for distribution of the cleaning solution onto the target surface in an efficacious pattern. If a replaceable reservoir is utilized, the replaceable reservoir may be inverted to provide for gravity flow of the cleaning solution. Or the cleaning solution may be pumped to the dispensing nozzles. The reservoir may be a bottle, and may made of plastic, such as a polyolefin. The cleaning implement (30) may have a needle to receive the cleaning solution from the bottle. The bottle may have a needle piercable membrane, complementary to the needle, and which is resealed to prevent undesired dripping of the cleaning solution during insertion and removal of the replaceable reservoir. A suitable reservoir and fitment therefor may be made according to the teachings of commonly assigned U.S. Pat. Nos. 6,386,392, 7,172,099; D388,705; D484,804; D485,178. A suitable cleaning implement (30) may be made according to the teachings of commonly assigned U.S. Pat. Nos. 5,888,006; 5,960,508; 5,988,920; 6,045,622; 6,101,661; 6,142,750; 6,579,023; 6,601,261; 6,722,806; 6,766,552; D477,701 and/or D487,174.

A duster style cleaning article according to the present invention may comprise a nonwoven sheet (35) having tow fibers joined thereto. The cleaning article may have a longitudinal axis. The tow fibers may be joined to the nonwoven sheet (35) in a generally transverse direction and particularly in a direction normal the longitudinal axis, to provide a laminate structure of two laminae. If desired, the cleaning article may comprise additional laminae. For example, the tow fibers may be disposed intermediate two nonwoven sheets (35). Plural laminae of tow fibers may be disposed intermediate the nonwoven sheets (35) and/or outboard thereof. Optionally, one or more of the nonwoven sheets (35) may be cut to provide comprise strips. The strips may be generally normal to the longitudinal axis. The tow fibers and/or nonwoven sheets (35) may comprise an additive to assist in removal of dust and other debris from the target surface. The additive may comprise wax, such as microcrystalline wax, oil, adhesive and combinations thereof. The cleaning article may be made according to U.S. Pat. No. 6,813,801. The laminae of the cleaning article may be joined together using adhesive, thermal bonding, ultrasonic welding, etc. If desired, the bonding lines may be generally parallel to the longitudinal axis and may be continuous, or discontinuous as desired. Three longitudinally parallel bonding lines may be utilized to define two sleeves. The two sleeves may accept one or more complementary fork tines of a handle (34). The fork tines may be removably inserted into the sleeves of the cleaning article to provide for improved ergonomics. The handle (34) may be plastic and made according to the teachings of U.S. Pat. Nos. 7,219,386; 7,293,317 and/or 7,383,602.

Referring to FIGS. 4-6B, the package (10) may be generally elongate, having a longitudinal axis sufficient to allow the package (10) to contain the head (32) and handle (34) of the cleaning implement (30). The handle (34) may be provided in discrete sections for later assembly, telescoping, or assembled in a long piece ready for immediate use. The discrete sections (34) of the handle (34) may be packaged together, in parallel, and in a generally longitudinal orientation, and assembled at the point of use in known fashion.

The implement (30) may be fixedly disposed within the package (10). By fixedly disposed, it is meant that the implement (30) does not become dislodged from the desired position between initial shipping and point of sale. The implement may be fixed using interior package partitions, adhesive, wire ties, etc., all in known fashion. It is simply desired that the implement (30), and particularly at least a portion of the head (32) thereof, be properly displayed through the window (27) at the point of sale. More particularly, it is desired that a portion of the head (32) and/or portion of the handle (34) be displayed without undue effort to restore proper appearance when the kit (9) is presented at the point of sale.

The various panels of the package (10) may be joined using tabs and mating slots, adhesive, etc. as are well known in the art. Each panel may be generally concave, convex, or may be flat in the most common configuration. Each panel may be solid, except as described herein, may be perforate or have any other desired configuration which provides adequate strength while permitting the shopper to view the package (10) in a display (50). Prophetically the top and/or back panels (14) may be omitted, and replaced with nonwoven, wire ties or other materials which hold the implement (30) within the package (10). The package (10) may comprise a corrugated cardboard, flat board stock, etc. A b-flute corrugated has been found to work well, although the invention is not so limited.

The back panel (14) may be generally or exactly solid, and may define the width and length of the package (10), as may be similarly defined by the front panel (12). The opposed side panels (21) may define the length of the package (10) and also define the depth of the package (10), which depth is variable. The top panel (16) and opposed bottom panel (18) define the width and variable depth of the package (10).

The back panel (14) may have an aperture (17) therethrough for hanging the kit (9) on a display (50) as is well known. As shown, optionally the front panel (12) may have a like aperture (17) registered with the aperture (17) on the back panel (14) to facilitate the display (50). A suitable display (50) may be made according to commonly assigned US 2014/0138512, particularly FIG. 9 thereof.

The aperture (17) for hanging the package (10) provides additional flexibility in the design of the kit (9). For example, a kit (9) need not be bottom-weighted to stand on a shelf. While a bottom weighted kit (9) may be feasible for some package (10) contents, this execution may be infeasible for a kit (9) having a cleaning implement (30) with a lengthy, elongate handle (34).

If a cleaning implement (30) is included with the kit (9), the cleaning implement (30) may be presented through the window (27) and/or the aperture (17) for viewing and assisting in the purchase decision. Furthermore, this arrangement advantageously allows the implement (30) to be displayed in a more typical in-use orientation, further assisting the purchase decision.

The front panel (12) may have a window (27) therethrough. The window (27) allows the user to conveniently view the implement (30) and/or refill sheets (35) while the kit (9) is on display. The head (32) may be at least partially visible through the window (27), and may particularly protrude, at least in part, through the window (27). The head (32) may protrude through the window (27) to a depth generally or identically equivalent to the greater side panel (21) depth. This arrangement provides the benefit that the head (32) is visible, usually without undue shadows, to a person shopping and approaching the kit (9) from either direction in an aisle at a retail store.

The refill sheets (35) may optionally be visible through the window (27) or not. If the refills (35) are not visible through the window, this arrangement provides the benefit that a less cluttered display of the implement (30) is presented through the window (27). If the refills (35) are visible, this arrangement provides the benefit that an ordinary white refill (35) may cover a brown corrugated and be more aesthetically pleasing, as well as show the refill (35) to a prospective purchaser.

The window (27) may be covered with a transparent film as is known in the art. Preferably the window (27) does not have a covering, to better accommodate the variable package (10) depth described herein.

The front panel (12) may have a front panel (12) top portion (12T) disposed above the window (27). The top portion (12T) may display indicia relevant to the branding and sale of the kit (9). The front panel (12) may have a front panel (12) bottom portion (12B) disposed below the window (27). The bottom portion (12B) may function to prevent the device from falling out. The bottom portion (12B) may also display indicia relevant to the consumer or display information required by law or local regulation. The bottom portion (12B) may have a longitudinal dimension of at least 3 or 4 cm, as measured from the edge of the bottom panel (18), to protect against the implement (30) falling through the window (27). The bottom portion (12B) of the front panel (12) is in a different plane than the top portion (12T) of the front panel (12). This arrangement provides the benefit that the information which may be desired to be more prominent to a shopper is displayed forward of other information on the bottom portion (12B) of the front panel (12).

The top portion (12T) and/or bottom portion (12B) may further have a transition (25) to advantageously provide a step for balancing area to display consumer information while revealing the head (32) and/or handle (34). The transition (25) may range from 50 to 100 mm in the longitudinal direction and may be 75 mm.

The bottom panel (18) may be solid and function to prevent contents of the kit (9) from falling out of the package (10) when on display. The top panel (16) may likewise be solid, or may be incomplete, perforate, or even omitted if one is not concerned about loss of the contents on display or during shipping, etc. The bottom panel (18) may have a lesser depth than the top panel (16), according to the present invention. The top panel (16) and bottom panel (18) may have the same width or may have a different width.

Both side panels (21) according to the invention have a variable depth. The side panels (21) may have a greater depth juxtaposed with the top than the bottom, or vice versa. Each side panel (21) may comprise a step, or other transition providing a difference in depth (22) between a region of relatively greater depth and a region of relatively lesser depth. The side panels (21) may be mirror images of one another or may have the differences in depth (22) at different positions along the longitudinal axis.

This arrangement provides the unpredicted benefit that a cleaning implement (30) stored in the package (10) may be visible from either the left side or the right side of the package (10). Such benefit is important because it is expected that prospective purchasers approach the kit (9) from both the left and right sides.

The region of relatively greater depth provides interior space for containing sheets (35), instructions for use, etc. Importantly, the cleaning implement (30) rarely has constant depth when packaged (10). The variable depth of the packaged cleaning implement (30) frequently occurs due to the superposition of the head (32) and handle (34), versus just the depth of either the head (32) or handle (34) alone. The variable package (10) depth of both side panels (21) allows the cleaning implement (30) to be packaged (10) so that at least a portion of the head (32) is visible through the window (27), without undue shadow being cast from a side panel (21) which is too deep and still allow for the deeper part of the package (10) where needed to accommodate increased depth of the implement (30).

The region of the side panels (21) having relatively greater depth may have a depth which is greater than the region of relatively lesser depth and which results in a difference in depths. The regions of greater depth may have a depth ranging from 4 to 18 cm, 3 to 15 cm or be 9 cm. The regions of the side panels (21) having a lesser depth may have a depth of at least 10, 20 or 30% but not more than 70, 80 or 90% of the greater side panel (21) depth. Such regions of lesser depth may provide a window (27) having a dimension, as measured along the distal edge of either side panel (21), of 20 to 70%, 30 to 60% and particularly 50% of the longitudinal dimension of the package (10).

Such difference is believed to be adequate to conserve material usage for cost and shipping consideration, yet be large enough to allow an implement (30), or portion thereof, to protrude forwardly and generally or exactly perpendicular to the longitudinal axis into window (27).

This arrangement provides the dual benefit of allowing the user to see the cleaning implement (30), and even a cleaning sheet (35), protruding through a package (10) window (27), to maximize visibility to the shopper, while meeting the competing need to contain other components of the kit (9) within the package (10).

It is simply desired that the portions of the side panels having lesser depth correspond in position to the window (27) in the front panel (12) of the package (10). Likewise, it is desired that at least some of the portions of the side panels (21) having lesser depth be registered across the longitudinal axis from each other, so that the window (27) can be properly formed.

If desired, the deeper part of the package (10) may be juxtaposed with the top and shallower part of the panel may be juxtaposed with the bottom. This arrangement provides the benefit that the head (32) of the implement (30) may be downwardly oriented, conforming to the common in-use orientation. The opposite arrangement is also contemplated having a greater package (10) depth juxtaposed with the top of the package (10).

One of skill will recognize a tri-depth, quad-depth, etc. package (10) is also possible, in addition to the dual depth package (10) described above. A tri-depth package (10) may have a greater depth near the center of the longitudinal axis, providing regions of lesser depth juxtaposed with the top and bottom of the package (10). The regions juxtaposed with the top and bottom of the package (10) may have mutually equal depths or may have mutually different depths, such depths being less than the depth at the center of the longitudinal axis. Conversely, the middle portion of the package (10) may have a lesser depth near the center of the package (10) and relatively greater depth at the top/bottom of the package (10). Again the relatively greater depths at the top/bottom of the package (10) may be mutually equally or mutually different. Of course, even more package (10) depths may be utilized, according to the specific side panels (21) used with the present invention.

If desired, the front panel (12) top portion (12T) may have a bottom edge (12E) which is straight and generally or exactly orthogonal to the longitudinal axis. Or, as shown, the bottom edge (12E) may be stepped, so that different amounts of the cleaning implement (30) may be visible through the window (27). The front panel (12) stepped arrangement provides the flexibility to customize the front of the package (10) to the actual shape of various cleaning implements (30).

A package (10) according to the present invention may be made stackable with like packages (10). A stackable package (30) may be made according to commonly assigned US 2014/013101.

Figure 7A:
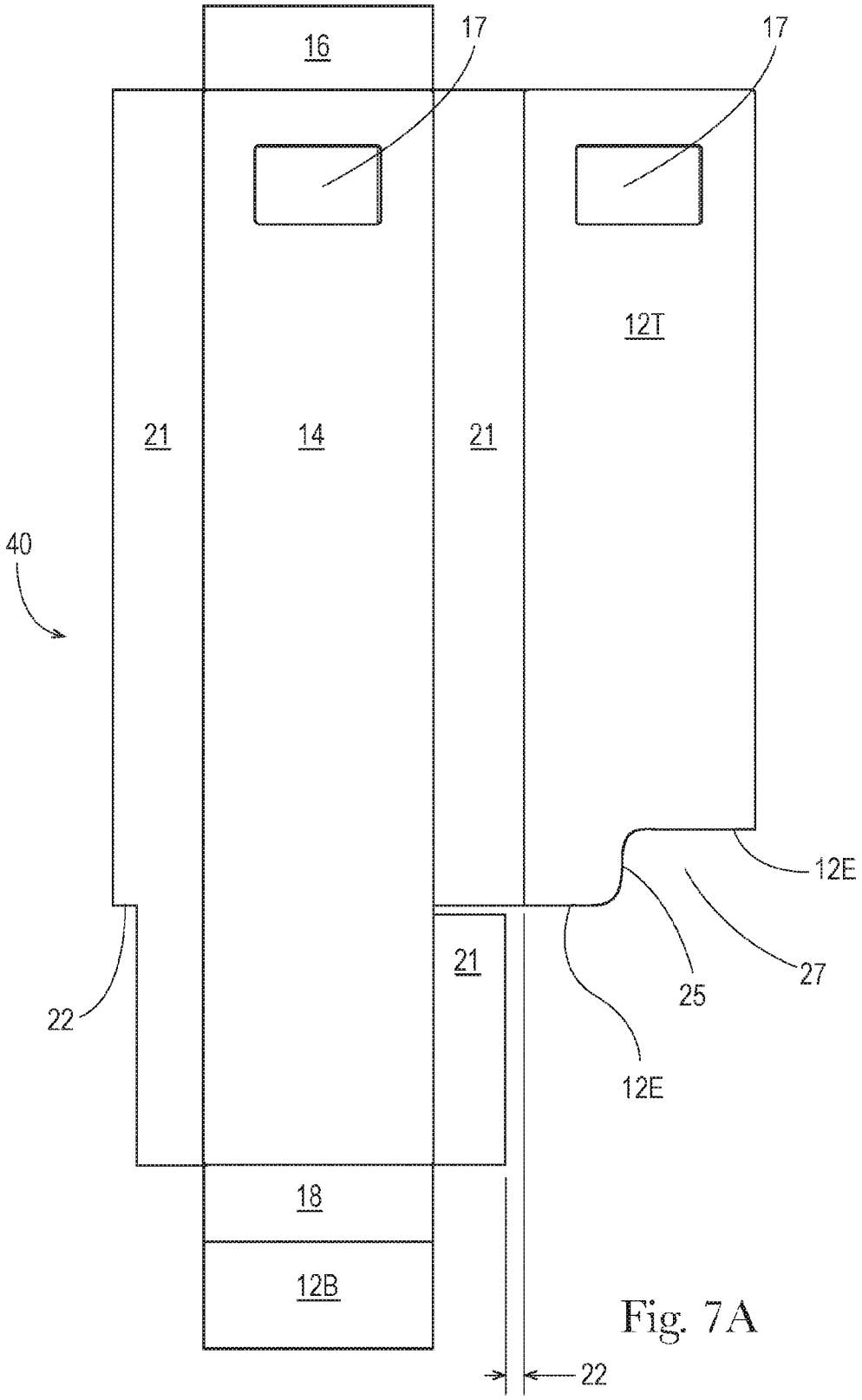
FIGS. 7A and 7B are plan views of alternative package blanks suitable for use as a package of the present invention and attendant kit.
Figure 7B:
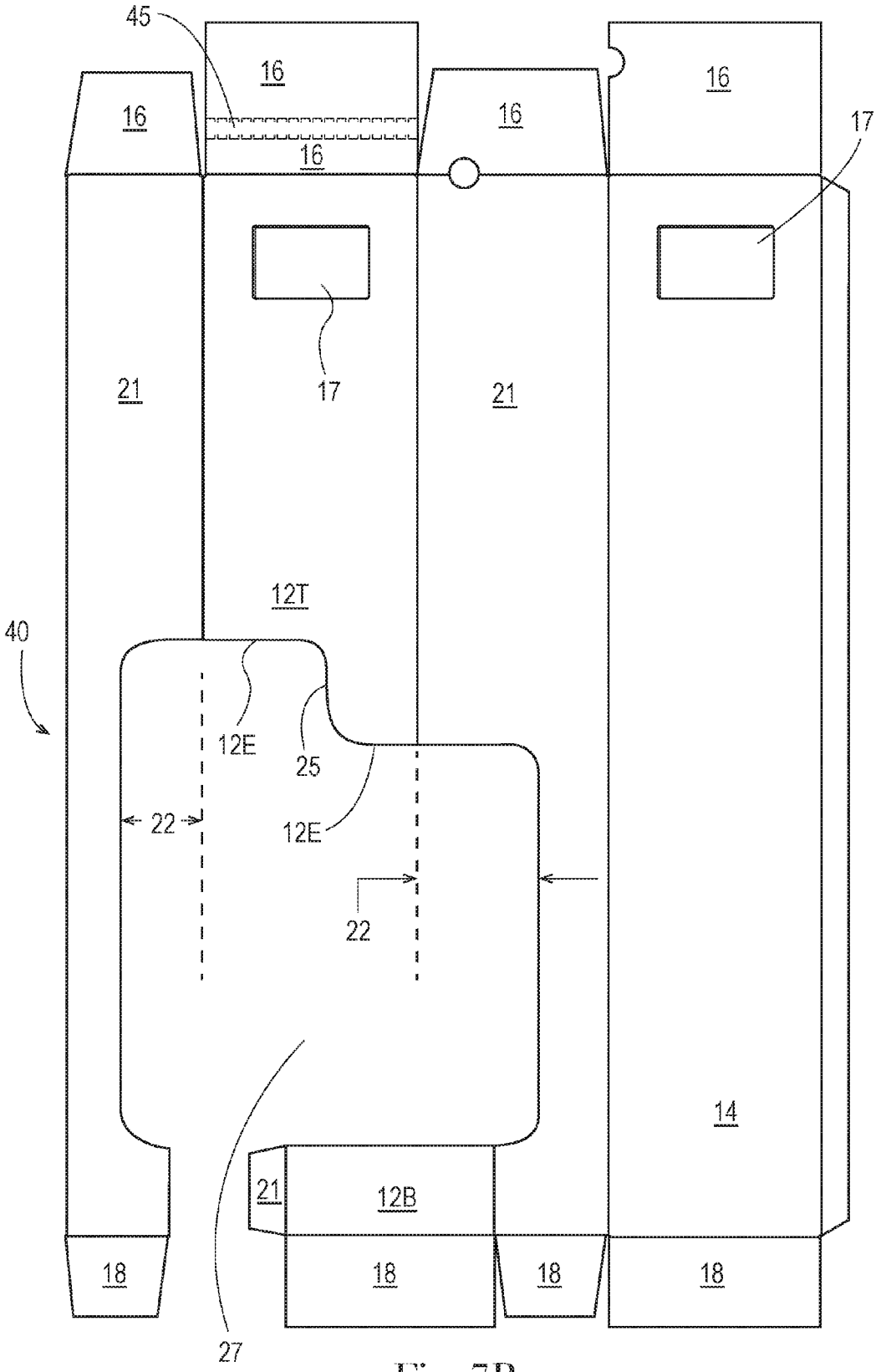

Referring to FIGS. 7A and 7B, the invention may comprise a blank (40). The blank (40) may comprise at least six panels, foldably connected and with side panels (21) and a window (27) as described herein for the package (10). By foldably connected it is meant that any one panel (12, 14, 16, 18, 21) of the package (10) is directly or indirectly joined to an adjacent or contiguous panel (12, 14, 16, 18, 21). The connection may comprise a single piece of material separated into panels (12, 14, 16, 18, 21) across a line of demarcation across a fold or other hinge, two separate pieces of material joined together at respective ends to make two panels (12, 14, 16, 18, 21), etc.

More particularly, the blank (40) may comprise a back panel (14). The back panel (14) may be elongate along a longitudinal axis, and generally or exactly central to the other panels of the blank (40). The top panel (16) and bottom panel (18) may be foldably connected to the top and bottom of the back panel (14). Two opposed side panels (21) may be foldably connected to opposed sides of the back panel (14). Each such panel (16, 16, 21) may be foldably connected to the back panel (14) at a respective proximal end and extend outwardly therefrom to a distal end.

As described above, the two side panels (21) each have a respective relatively greater and relatively lesser depth as measured from the proximal end to the distal end thereof. The relatively greater and relatively lesser depth between the proximal end and distal end of the side panels (21) may interface at a transition to provide a difference in depth (22), which transition may be a single step, plural steps, gradual slope, etc. The portion of each side panel (21) having relatively lesser depth may have a length, taken in the longitudinal direction of at least 5, 10, 20, 30, 40, 50 or 60 cm but not more than 100 or 90 cm.

Further, such portion of each side panel (21), particularly the distal end thereof, having relatively lesser depth is aligned, across the window (27) in the front of the package (10) with a corresponding portion of the other side panel (21). Such correspondence may occur for a longitudinal overlap relative to the distal end of the opposing side flap of at least 10, 20, 30, 40 or 50 cm, but not more than 100 or 90 cm, so that a window (27) adequate to display the implement (30), and particularly the head (34) thereof, is created. The window (27) may have a longitudinal dimension, as measured along the distal end of a side panel (21), of 5 to 40 cm, 10 to 30 cm, and may particularly be 25 cm or more.

As noted above, at least a portion of the implement (30) may protrude through the window (27) thus created. Such longitudinal overlap is believed to be adequate to conserve material usage for cost and shipping consideration, yet be large enough to allow an implement (30), or portion thereof, to protrude forwardly, perpendicular to the longitudinal axis and into window (27).

A front top panel (12T) may be foldably joined to the distal end of the top panel (16) and/or to one or both of the distal end(s) of the side panels (21). Likewise, a front bottom panel (12B) may be foldably joined to the distal end of the bottom panel (18) and/or to one or both of the distal end(s) of the side panels (21). This arrangement provides for a window (27) to be formed between the front top panel (12T) and front bottom panel (12B).

A suitable blank (40) may be shipped flat, as is commonly known, to conserve shipping space. The blank (40) may be erected into a package (10) at the point of sale or at the point where the blank (40) is assembled into a kit (9). The blank (40) may be entirely flat or may be partially assembled as a sleeve. Upon complete assembly, the blank (40) yields a package (10) as described and claimed herein.

Referring specifically to FIG. 7B, the blank (40) may have an optional tear strip (45) to assist with access to the contents of the kit (9) at the point of first use. While a constant width package (10) is shown, the invention is not so limited. The package may be of non-constant width and particularly may have a step change in width at or juxtaposed with a bottom edge (12E).

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein. The adjectives 'generally' and 'substantially' include the specific embodiments where the modified noun exactly meets the criterion of that adjective and functional equivalents thereto.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank for forming a generally parallelepipedally shaped package suitable for holding a cleaning implement therein, and forming an open window, said blank comprising:

an elongate back panel defining a longitudinal axis, said back panel having a top and a bottom opposed thereto, said top and said bottom each defining a width of said back panel and having a first side and second side opposed thereto, each of said sides defining a length of said back panel, a top panel extending outwardly from a top panel proximal end joined to said back panel to a top panel distal end spaced apart from said top panel proximal end, and said top panel being foldably connected at said top panel proximal end to said top of said back panel, a bottom panel extending outwardly from a bottom panel proximal end to a bottom panel distal end, and being foldably connected at said proximal end to said bottom of said back panel, two opposed side panels, each said side panel extending from a side panel proximal end to a distal end and defining a depth of said package therebetween, each said side panel being foldably connected at a side panel proximal end to a respective one of said opposed sides of said back panel, wherein each said side panel has a respective relatively greater dimension defining a relatively greater depth of said package and relatively lesser dimension defining a relatively lesser depth of said package as measured from said side panel proximal end to said side panel distal end thereof, said relatively lesser dimension of each said side panel being aligned across said longitudinal axis with said relatively lesser dimension of said opposing side panel, a front top panel foldably joined to said distal end of at least one of said top panel and one or both of said distal ends of said side panels, and a front bottom panel foldably joined to said distal end of said bottom panel and/or to one or both of said distal end(s) of said side panels, said front top panel and said front bottom panel being longitudinally spaced apart to provide for a window to be formed between said front top panel and said front bottom panel, whereby said window is longitudinally aligned with said lesser dimension of both said opposed side panels.

2. A blank according to claim 1 further comprising a back aperture in said back panel and a front aperture aligned therewith in said front top panel, said back aperture and said front aperture being longitudinally aligned with said relatively greater dimension of said side panels.

3. A blank according to claim 2 wherein each said side panel has a respective difference between said relatively lesser dimension and said relatively greater dimension, said respective difference of each said side panel being between 5 and 30 cm.

4. A blank according to claim 3 wherein each said side panel has a respective difference between said relatively lesser dimension and said relatively greater dimension, said respective difference of each said side panel being between 20 and 80% of said greater dimension.

5. A blank according to claim 4 wherein each said side panel has a respective difference between said relatively lesser dimension and said relatively greater dimension, said respective difference of each said side panel being between 30 and 70% of said greater dimension.

6. An elongate generally parallelepipedally shaped package for holding a cleaning implement therein and defining a longitudinal axis, said package having a top, bottom, two sides, a front, a back and having an open window in at least the front, said package comprising:

at least one front panel, said front panel comprising a top front portion and a bottom front portion longitudinally spaced therefrom to form said open window therebetween, a back panel opposed to said top front panel and said bottom front panel, said back panel and said front panel being joined by a top panel and by a bottom panel opposed thereto, said top panel defining a top panel dimension, said bottom panel defining a bottom panel dimension, said top panel dimension and said bottom panel dimension not being equal to each other, and said back panel and said front panel being further joined by two opposed elongate side panels, extending from said top panel to said bottom panel, each said side panel having an elongate portion of greater dimension and an elongate portion of lesser dimension, said elongate portions of said lesser dimension of said respective side panels being longitudinally aligned to form said open window therebetween, and further comprising a back aperture in said back panel and a front aperture aligned therewith in said front panel, said back aperture and said front aperture being spaced apart and longitudinally aligned with said greater dimension of said side panels.

7. A package according to claim 6 wherein said portion of said greater dimension is juxtaposed with said top of said package.

8. A package according to claim 6 wherein said window has a longitudinal dimension, as measured along either said side panel, ranging from 10 to 40 cm.

9. A package according to claim 8 wherein said package has a package length and said window comprises 30 to 70 percent of said package length.

10. A kit having a longitudinal axis and comprising an elongate generally parallelepipedally shaped, variable dimension package having a cleaning implement therein, said variable dimension package having a top, a bottom, two opposed sides, a front, a back and an open window in at least the front, said package comprising:

a front panel, said front panel comprising a top front panel and a bottom front panel longitudinally spaced therefrom and forming an open window therebetween, a back panel opposed to said top front panel and said bottom front panel, said back panel and said front panel being joined by a top panel and by a bottom panel opposed thereto, said top panel defining a top panel dimension, said bottom panel defining a bottom panel dimension, one of said top panel dimension being greater than the other of said bottom panel dimension, said back panel and said front panel being further joined by two opposed elongate side panels, and defining a package width between said side panels, each said side panel having an elongate portion of greater dimension juxtaposed with the top of said package, and having an elongate portion of lesser dimension juxtaposed with the bottom of said package, said elongate portions of said lesser dimension of said side panels being longitudinally overlapped to form an open window therebetween, and a cleaning implement fixedly disposed in said package, said cleaning implement having a head and an elongate handle articulably joined thereto, at least a portion of said head being visible through said window and wherein said implement has a universal joint to facilitate connection of said elongate handle to said head, said universal joint being visible through said window, wherein said package has a package width and said head has a dimension, said head dimension generally conforming to said package width, so that said head fits snugly within said package.

11. A kit according to claim 10 wherein said head is disposed generally parallel to the longitudinal axis and held in fixed relation to said handle while disposed in said package.

12. A kit according to claim 10 wherein said head is visible through said window, except for a portion of said head concealed by said bottom front panel.

13. A kit according to claim 10 further comprising at least one cleaning sheet which is removably attachable to said implement.

14. A kit according to claim 13 wherein said at least one sheet is visible through said window.

15. A kit according to claim 13 wherein said at least one sheet is not visible through said window.

16. A kit according to claim 15 wherein said window subtends the entire width of said front of said package.

17. A kit according to claim 16 wherein said head protrudes, in part, through said window.

* * * * *